US007255027B1

(12) United States Patent
Tsai

(10) Patent No.: US 7,255,027 B1
(45) Date of Patent: Aug. 14, 2007

(54) SELF-ADJUSTING PLIER DEVICE

(76) Inventor: Cheng Chang Tsai, No. 466, Chengong Road, Taiping City, Taichung 41166 (TW)

( * ) Notice: Subject to any disclaimer, the term of this patent is extended or adjusted under 35 U.S.C. 154(b) by 0 days.

(21) Appl. No.: 11/510,095

(22) Filed: Aug. 25, 2006

(51) Int. Cl.
*B25B 7/04* (2006.01)
*B25B 7/10* (2006.01)

(52) U.S. Cl. ..... 81/408; 81/357

(58) Field of Classification Search ..... 81/404–407, 81/413, 416, 355, 357, 427
See application file for complete search history.

(56) References Cited

U.S. PATENT DOCUMENTS 2,428,949 A * 10/1947 Ward et al. ..... 81/367
3,534,641 A * 10/1970 Le Duc ..... 81/357
4,651,598 A 3/1987 Warheit ..... 81/408
5,020,399 A 6/1991 Annis et al. ..... 81/358
5,060,543 A 10/1991 Warheit ..... 81/409
6,199,459 B1 * 3/2001 Azkona ..... 81/411

* cited by examiner

*Primary Examiner*—David B Thomas
(74) *Attorney, Agent, or Firm*—Charles E. Baxley

(57) ABSTRACT

A plier device includes two elongated handle member each having an intermediate neck portion formed between a jaw and a handle, an elongated channel and a number of teeth are formed in one of the handle members, and an orifice is formed in the other handle member for pivotally engaging a shaft of a pawl member which includes one or more teeth for engaging with the teeth of the handle member. A spring member is attached to one of the handle members and has a leg engaged with the pawl member and the other leg engaged with the handle member for biasing the tooth of the pawl member to engage with the teeth of the handle member. A frame may solidly anchor the pawl member to the handle members.

7 Claims, 4 Drawing Sheets

SELF-ADJUSTING PLIER DEVICE

BACKGROUND OF THE INVENTION

1. Field of the Invention

The present invention relates to a plier device, and more particularly to a self-adjusting plier device including a structure or arrangement for allowing the parts or elements of the plier device to be easily and quickly assembled and to be solidly anchored and assembled together.

2. Description of the Prior Art

Typical plier devices comprise two longitudinal handle members each having an intermediate neck portion formed or defined between a jaw end and a handle end, an elongated channel and a number of ratchet teeth formed in the intermediate neck portion of one of the handle members, and a pawl member pivotally attached to the other handle member and engageable into the elongated channel of the handle member for forming a self-adjusting plier device.

For example, U.S. Pat. No. 4,651,598 to Warheit discloses one of the typical self-adjusting utility pliers also comprising a pawl member pivotally attached to one of two handle members and engageable into an elongated channel of the other handle member for automatically adjusting to positions of positive gripping and holding of any size workpiece within the size range defined by the maximum opening between the jaws of the pliers.

Normally, the pawl member is pivotally attached or secured between the handle members with a bolt and a nut, and the bolt will be engaged through the pawl member and one of the handle members such that the bolt will suffer a great shear force formed or generated between the handle members. In addition, the bolt and the nut will have a good chance to be disengaged from the pawl member and the handle members after operations.

U.S. Pat. No. 5,020,399 to Annis et al. discloses another typical self-adjusting utility pliers also comprising a pawl member pivotally attached to one of two handle members and engageable into an elongated channel of the other handle member for automatically adjusting to positions of positive gripping and holding of any size workpiece within the size range defined by the maximum opening between the jaws of the pliers.

However, similarly, the pawl member is also pivotally attached or secured between the handle members with a bolt and a nut, and the bolt will also suffer a great shear force formed or generated between the handle members, such that the bolt and the nut will also have a good chance to be disengaged from the pawl member and the handle members after operations.

U.S. Pat. No. 5,060,543 to Warheit discloses a further typical self-adjusting utility plier device also comprising a pawl member pivotally attached to one of two handle members and engageable into an elongated channel of the other handle member for automatically adjusting to positions of positive gripping and holding of any size workpiece within the size range defined by the maximum opening between the jaws of the pliers.

However, similarly, the pawl member is also required to be pivotally attached or secured between the handle members with such as a bolt and a nut, and the bolt will also suffer a great shear force formed or generated between the handle members, such that the bolt and the nut will also have a good chance to be disengaged from the pawl member and the handle members after operations.

The present invention has arisen to mitigate and/or obviate the afore-described disadvantages of the conventional self-adjusting plier devices.

SUMMARY OF THE INVENTION

The primary objective of the present invention is to provide a self-adjusting plier device including a structure or arrangement for allowing the parts or elements of the plier device to be easily and quickly assembled and to be solidly anchored and assembled together.

In accordance with one aspect of the invention, there is provided a plier device comprising a first elongated handle member including an intermediate neck portion formed between a jaw and a handle, and including an elongated channel formed in the intermediate neck portion of the first elongated handle member, and including a number of teeth formed in the intermediate neck portion of the first elongated handle member and provided in the elongated channel of the first elongated handle member, a second elongated handle member including an intermediate neck portion formed between a jaw and a handle, and an orifice formed in the intermediate neck portion of the second elongated handle member, a pawl member including a shaft having a first end pivotally engaged into the orifice of the second elongated handle member for pivotally coupling the pawl member to the second elongated handle member, and including at least one tooth for engaging with the teeth of the first elongated handle member and for allowing a workpiece to be gripped between the jaws of the first and the second handle members, and a spring member attached to the second elongated handle member and including a first leg engaged with the pawl member, and including a second leg engaged with the second elongated handle member for biasing the tooth of the pawl member to engage with the teeth of the first elongated handle member, and the tooth of the pawl member may be disengageable from the teeth of the first elongated handle member when the handles of the first and the second handle members are moved away from each other until the tooth of the pawl member are disengaged from the teeth of the first elongated handle member and when the spring member may not bias and force the tooth of the pawl member to engage with the teeth of the first elongated handle member, for allowing the pawl member to be moved and adjusted along the elongated channel of the first elongated handle member and to allow the jaws of the first and the second handle members to be quickly adjusted relative to each other.

The second elongated handle member includes a peripheral recess formed in the intermediate neck portion thereof for receiving the spring member. The peripheral recess is located around the orifice of the second elongated handle member for forming a peripheral wall between the orifice and the peripheral recess of the second elongated handle member.

The second elongated handle member includes a curved groove formed therein, the first and the second legs of the spring member are engaged into the curved groove of the second elongated handle member. The first and the second legs of the spring member are extended from the spring member and perpendicular to the spring member.

The shaft of the pawl member includes a cavity formed in the first end thereof, and a cap includes a stud engaged into the cavity of the pawl member for enclosing the orifice of the second elongated handle member. The second elongated handle member includes a frame secured thereto and engaged with the pawl member for anchoring the pawl member to the second elongated handle member.

The frame includes an aperture formed therein, and the shaft of the pawl member includes a second end rotatably engaged in the aperture of the frame. The frame includes two brackets extended from a bar for forming a space between the brackets and the bar and for movably receiving the intermediate neck portion of the first elongated handle member. The brackets of the frame may be solidly secured to the second elongated handle member with such as fasteners.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
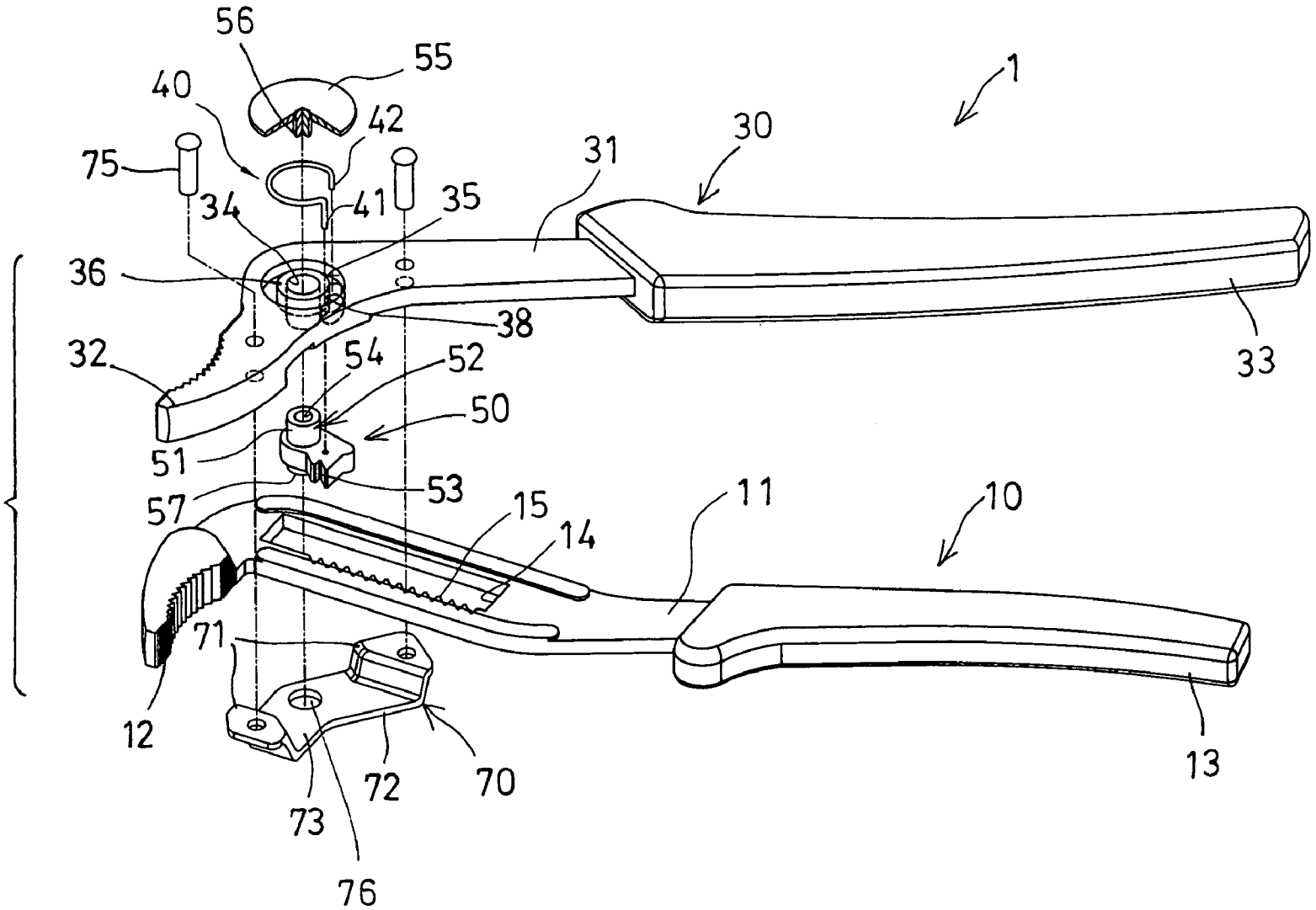
FIG. 1 is an exploded view of a self-adjusting plier device in accordance with the present invention.
Figure 2:
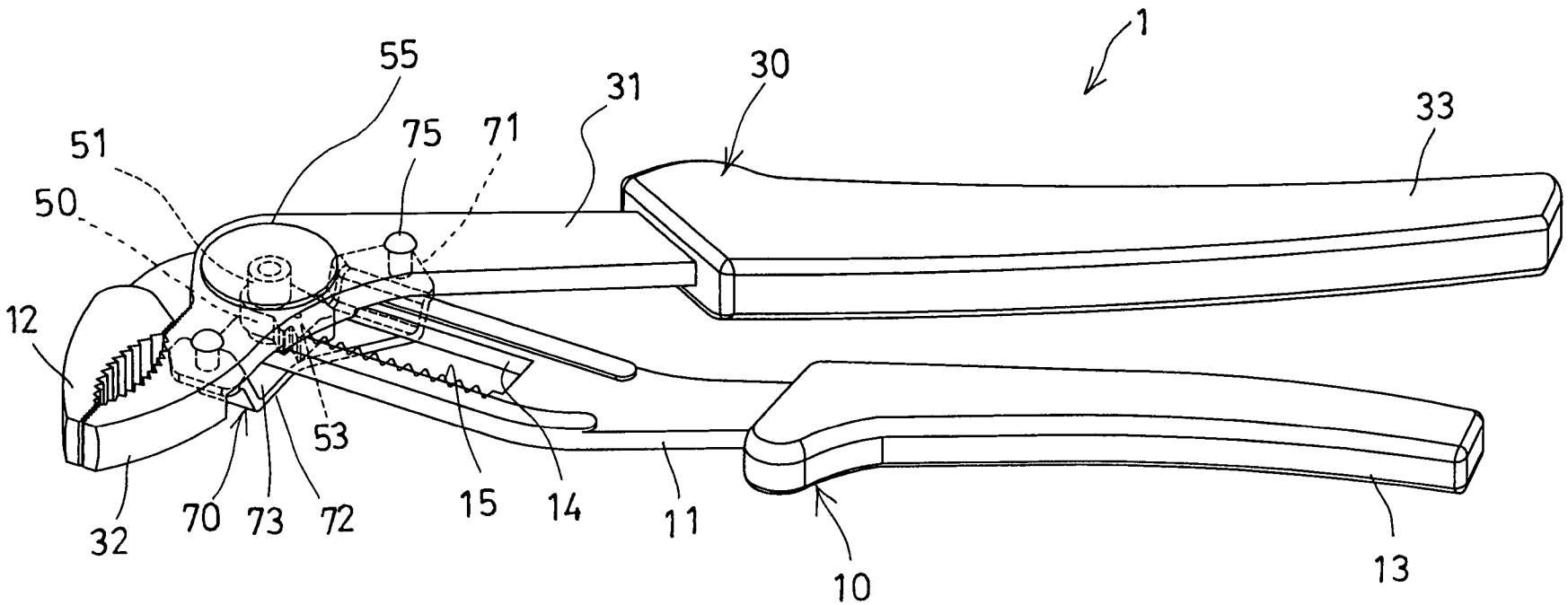
FIG. 2 is a perspective view of the self-adjusting plier device.
Figure 3:
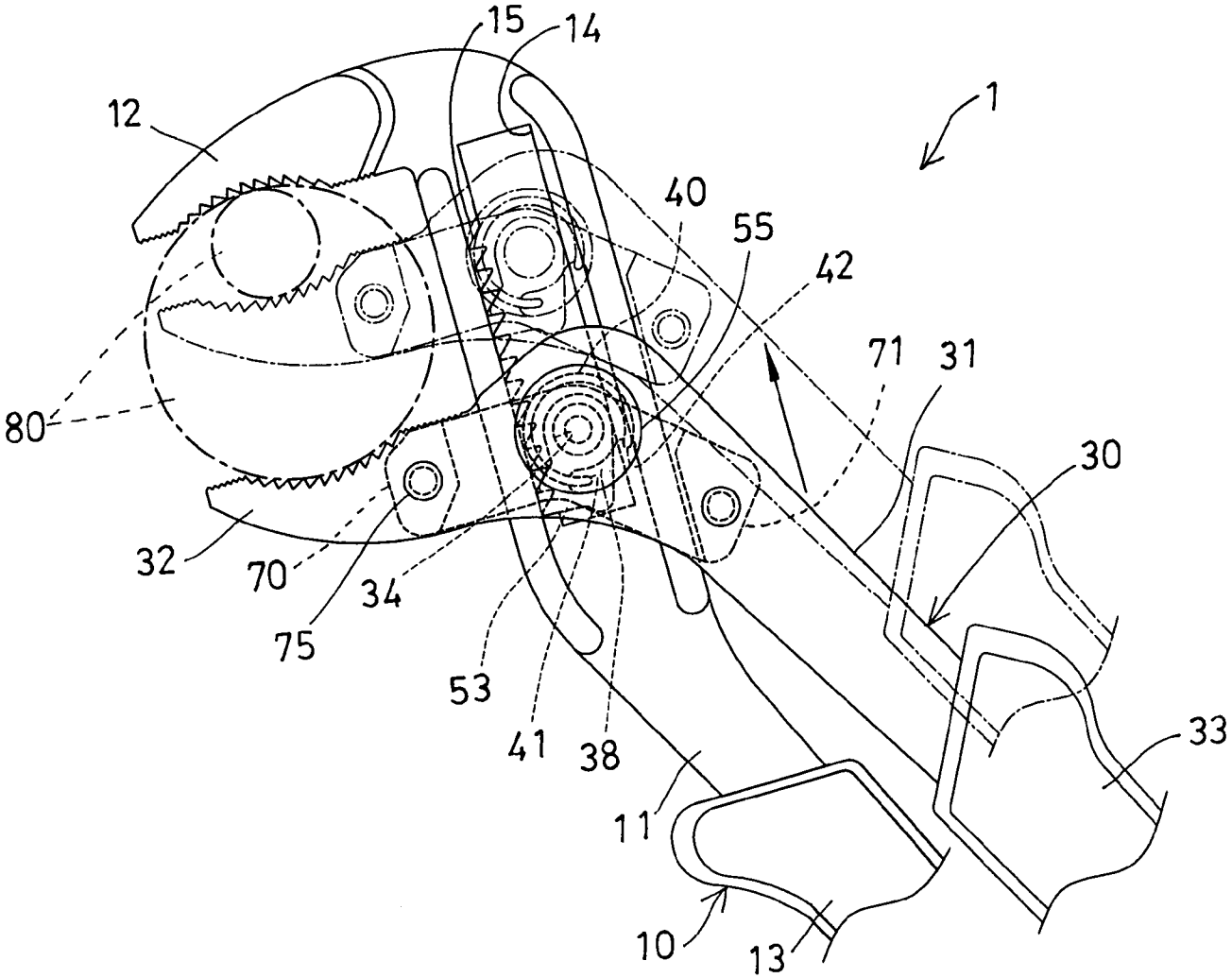
FIG. 3 is a partial plan schematic view of the self-adjusting plier device.

Referring to the drawings, and initially to FIGS. 1-3, a self-adjusting plier device 1 in accordance with the present invention comprises a first elongated handle member 10 including an intermediate neck portion 11 formed or defined between a jaw or jaw end 12 and a handle or handle end 13, an elongated channel 14 formed in the intermediate neck portion 11 of the first elongated handle member 10, and further including a number of teeth 15, such as ratchet teeth 15 also formed in the intermediate neck portion 11 of the first elongated handle member 10 and provided or extended into the elongated channel 14 of the first elongated handle member 10.

The self-adjusting plier device 1 further includes a second elongated handle member 30 also having an intermediate neck portion 31 formed or defined between a jaw end 32 and a handle end 33, and an orifice 34 formed in the intermediate neck portion 31 or the jaw end 32 of the second elongated handle member 30 or located between the intermediate neck portion 31 and the jaw end 32 of the second elongated handle member 30, and a peripheral recess 35 formed in an outer portion of the second elongated handle member 30 and formed or located around the orifice 34 of the second elongated handle member 30 for forming or defining a peripheral wall 36 between the orifice 34 and the peripheral recess 35 of the second elongated handle member 30.

The second elongated handle member 30 further includes a curved groove 38 formed through the second elongated handle member 30, and formed or located around the peripheral wall 36 and communicating with the peripheral recess 35 of the second elongated handle member 30. A spring member 40, such as a ring-shaped spring member 40 is received or engaged in the peripheral recess 35 of the second elongated handle member 30 or attached to the second elongated handle member 30 and disposed or located around the peripheral wall 36, and includes a longer or first leg 41, and a shorter or second leg 42 engaged with the second elongated handle member 30, in which both legs 41, 42 are bent or extended from the spring member 40 and preferably perpendicular to the spring member 40 and engaged into or through the curved groove 38 of the second elongated handle member 30.

A pawl member 50 includes a shaft 51 extended therefrom and having one or first or upper end 52 rotatably or pivotally and snugly engaged into the orifice 34 of the second elongated handle member 30 for solidly anchoring or coupling the pawl member 50 to the second elongated handle member 30 and for allowing the coupling between the shaft 51 of the pawl member 50 and the second elongated handle member 30 to suffer or resist a greater shearing force that may be formed or generated between the first and the second handle members 10, 30. The pawl member 50 includes one or more teeth 53 for engaging with the teeth 15 of the first elongated handle member 10 and for allowing the workpieces to be suitably gripped or held between the jaws 12, 32 of the first and the second handle members 10, 30.

The longer leg 41 of the spring member 40 may be engaged with the pawl member 50, and the shorter leg 42 of the spring member 40 may be engaged with the second elongated handle member 30 for allowing the spring member 40 to bias or to force the teeth 53 of the pawl member 50 to engage with the teeth 15 of the first elongated handle member 10. The pawl member 50 includes a cavity 54 formed in the one or upper end 52 thereof, and a cap 55 includes a stud 56 extended therefrom and engaged into the cavity 54 of the pawl member 50 with such as force-fitted engagements, for enclosing or shielding the orifice 34 and the peripheral recess 35 of the second elongated handle member 30 and for stably anchoring or retaining the spring member 40 in the peripheral recess 35 of the second elongated handle member 30 or for preventing the spring member 40 from being disengaged from the second elongated handle member 30.

A frame 70 includes two brackets 71 extended from two sides or two ends of a bar 72 for forming or defining a space 73 between the brackets 71 and the bar 72 and for loosely or movably receiving the intermediate neck portion 11 of the first elongated handle member 10. The brackets 71 are engaged with the intermediate neck portion 31 and/or the jaw end 32 of the second elongated handle member 30 and secured to the second elongated handle member 30 with such as latches or fasteners 75, such as rivets 75 for solidly anchoring or coupling or securing the frame 70 to the second elongated handle member 30. The frame 70 includes an aperture 76 formed therein for rotatably receiving a lower or second end 57 of the shaft 51 of the pawl member 50 and for solidly anchoring or coupling or securing the pawl member 50 to the second elongated handle member 30 and/or between the first and the second handle members 10, 30.

In operation, as shown in FIG. 3, the spring member 40 may bias or force the teeth 53 of the pawl member 50 to engage with the teeth 15 of the first elongated handle member 10 for allowing the jaws 12, 32 of the first and the second handle members 10, 30 to be moved toward or away from each other with the handles 13, 33, and for allowing the workpieces 80 to be suitably gripped or held or grasped or clamped between the jaws 12, 32 of the first and the second handle members 10, 30 by moving or forcing the handles 13, 33 of the first and the second handle members 10, 30 toward each other.

Figure 4:
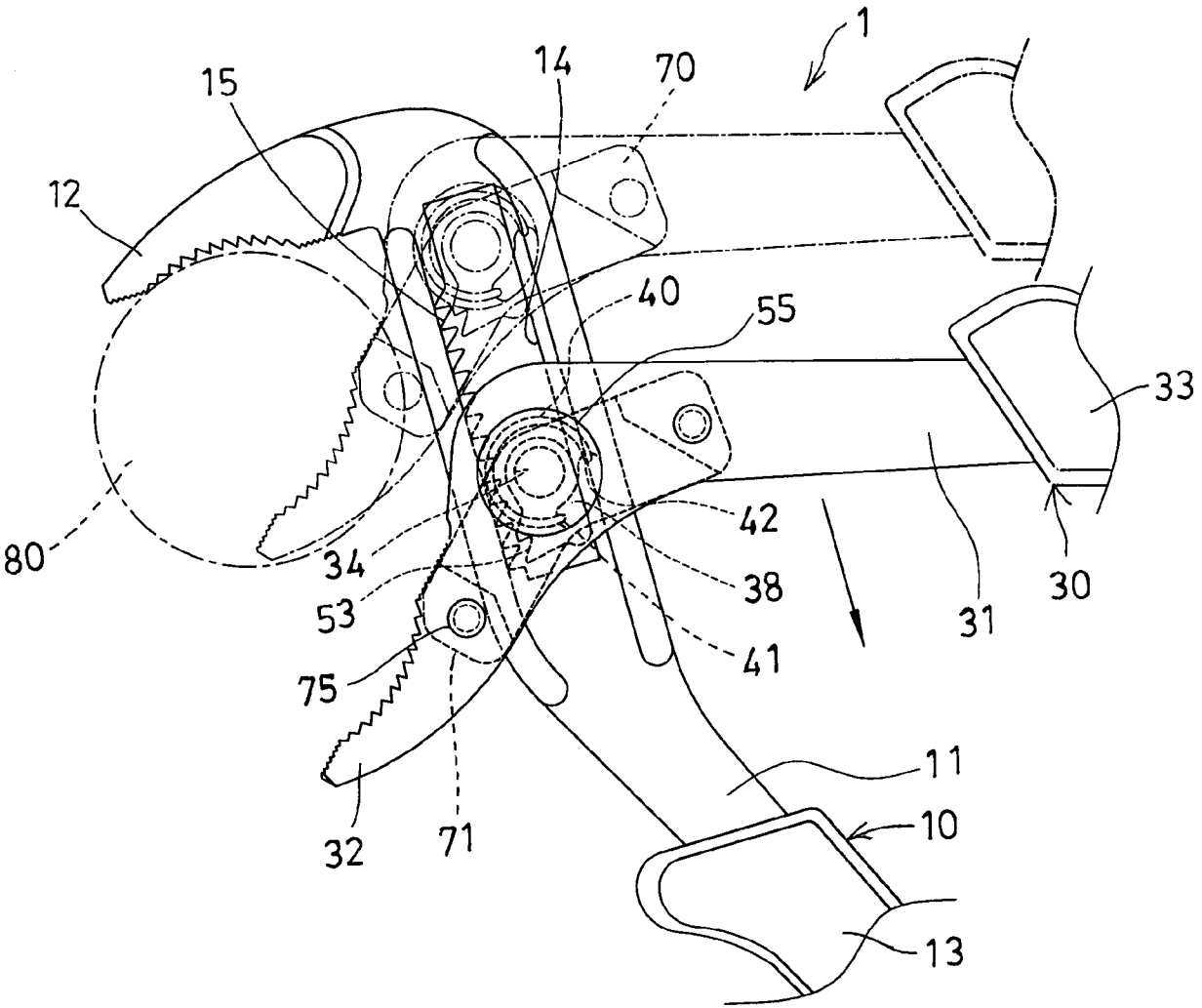
FIG. 4 is a partial plan schematic view similar to FIG. 3, illustrating the operation of the self-adjusting plier device.

As shown in FIG. 4, when the handles 13, 33 of the first and the second handle members 10, 30 are moved farther away from each other until the teeth 53 of the pawl member 50 are disengaged from the teeth 15 of the first elongated handle member 10, or when the spring member 40 may not bias or force the teeth 53 of the pawl member 50 to engage with the teeth 15 of the first elongated handle member 10, the pawl member 50 may be quickly moved or adjusted along the elongated channel 14 of the first elongated handle member 10 to allow the jaws 12, 32 of the first and the second handle members 10, 30 to be easily and quickly moved or adjusted relative to each other to different sizes or distances and to suitably grip or grasp or clamp the workpieces 80 (FIGS. 3, 4) between the jaws 12, 32 of the first and the second handle members 10, 30.

It is to be noted that the engagement between the shaft 51 of the pawl member 50 and the second elongated handle member 30 allows the self-adjusting plier device 1 to suffer or resist a greater shearing force that may be formed or generated between the first and the second handle members 10, 30. In addition, the spring member 40 may bias or force the teeth 53 of the pawl member 50 to solidly engage with the teeth 15 of the first elongated handle member 10. Furthermore, the pawl member 50 may be solidly anchored or coupled or secured to the second elongated handle member 30 and/or between the first and the second handle members 10, 30 with the frame 70 for allowing the self-adjusting plier device 1 to be effectively operated or actuated by the users.

Accordingly, the self-adjusting plier device in accordance with the present invention includes a structure or arrangement for allowing the parts or elements of the plier device to be easily and quickly assembled and to be solidly anchored and assembled together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A plier device comprising:

a first elongated handle member including an intermediate neck portion formed between a jaw and a handle, and including an elongated channel formed in said intermediate neck portion of said first elongated handle member, and including a plurality of teeth formed in said intermediate neck portion of said first elongated handle member and provided in said elongated channel of said first elongated handle member, a second elongated handle member including an intermediate neck portion formed between a jaw and a handle, and an orifice formed in said intermediate neck portion of said second elongated handle member, a pawl member including a shaft having a first end pivotally engaged into said orifice of said second elongated handle member for pivotally coupling said pawl member to said second elongated handle member, and including at least one tooth for engaging with said teeth of said first elongated handle member and for allowing a workpiece to be gripped between said jaws of said first and said second handle members, said second elongated handle member including a frame secured thereto and engaged with said pawl member for anchoring said pawl member to said second elongated handle member, said frame including two brackets extended from a bar for forming a space between said brackets and said bar and for movably receiving said intermediate neck portion of said first elongated handle member, and said brackets of said frame being secured to said second elongated handle member with fasteners, and a spring member attached to said second elongated handle member and including a first leg engaged with said pawl member, and including a second leg engaged with said second elongated handle member for biasing said at least one tooth of said pawl member to engage with said teeth of said first elongated handle member, and said at least one tooth of said pawl member being disengageable from said teeth of said first elongated handle member when said handles of said first and said second handle members are moved away from each other until said at least one tooth of said pawl member are disengaged from said teeth of said first elongated handle member and when said spring member may not bias and force said at least one tooth of said pawl member to engage with said teeth of said first elongated handle member, for allowing said pawl member to be moved and adjusted along said elongated channel of said first elongated handle member and to allow said jaws of said first and said second handle members to be quickly adjusted relative to each other.

2. The plier device as claimed in claim 1, wherein said second elongated handle member includes a peripheral recess formed in said intermediate neck portion thereof for receiving said spring member.

3. The plier device as claimed in claim 2, wherein said peripheral recess is located around said orifice of said second elongated handle member for forming a peripheral wall between said orifice and said peripheral recess of said second elongated handle member.

4. The plier device as claimed in claim 1, wherein said second elongated handle member includes a curved groove formed therein, said first and said second legs of said spring member are engaged into said curved groove of said second elongated handle member.

5. The plier device as claimed in claim 1, wherein said first and said second legs of said spring member are extended from said spring member and perpendicular to said spring member.

6. The plier device as claimed in claim 1, wherein said shaft of said pawl member includes a cavity formed in said first end thereof, and a cap includes a stud engaged into said cavity of said pawl member for enclosing said orifice of said second elongated handle member.

7. The plier device as claimed in claim 1, wherein said frame includes an aperture formed therein, and said shaft of said pawl member includes a second end rotatably engaged in said aperture of said frame.

* * * * *